US006764970B1

(12) United States Patent
Kuoni

(10) Patent No.: US 6,764,970 B1
(45) Date of Patent: Jul. 20, 2004

(54) WOVEN LABELS WITH AN INVISIBLE BAR CODE

(75) Inventor: Christian Kuoni, Zeiningen (CH)

(73) Assignee: Textilma AG, Hergiswill (CH)

( * ) Notice: Subject to any disclaimer, the term of this patent is extended or adjusted under 35 U.S.C. 154(b) by 0 days.

(21) Appl. No.: 09/980,292

(22) PCT Filed: Apr. 27, 2000

(86) PCT No.: PCT/CH00/00234

§ 371 (c)(1),
(2), (4) Date: Nov. 29, 2001

(87) PCT Pub. No.: WO00/73559

PCT Pub. Date: Dec. 7, 2000

(30) Foreign Application Priority Data

May 29, 1999 (CH) ..... 1011/99

(51) Int. Cl.[7] ..... D03D 15/00

(52) U.S. Cl. ..... 442/301; 283/72; 283/85; 283/86; 283/87; 283/88; 283/89; 283/91; 380/572.1; 428/29; 428/30; 428/906.6; 428/913; 428/916; 428/373; 428/397; 428/399; 428/401; 428/402; 428/690; 442/203; 442/204; 442/205; 442/206; 442/207; 442/208; 139/426 R

(58) Field of Search ..... 139/426 R; 283/72, 283/85–89, 91; 380/572.1; 428/29, 30, 906.6, 913, 916, 373, 397, 399, 401, 402, 690; 442/203–208, 301

(56) References Cited

U.S. PATENT DOCUMENTS

| | | | | |
|---|---|---|---|---|
| 5,112,420 | A | 5/1992 | Diesner | |
| 5,583,489 | A | * 12/1996 | Loemker et al. | 340/572.8 |
| 5,824,393 | A | * 10/1998 | Nakamura | 428/195.1 |
| 5,941,572 | A | * 8/1999 | Gundjian et al. | 283/67 |
| 6,068,895 | A | * 5/2000 | Kimura | 428/29 |
| 6,086,966 | A | * 7/2000 | Gundjian et al. | 428/29 |
| 6,203,069 | B1 | * 3/2001 | Outwater et al. | 283/88 |
| 6,255,948 | B1 | * 7/2001 | Wolpert et al. | 340/572.8 |
| 2002/0014967 | A1 | * 2/2001 | Crane et al. | 340/572.8 |
| 2001/0028169 | A1 | * 10/2001 | Lazzerini | 283/84 |
| 2002/0160188 | A1 | * 10/2002 | Tam et al. | 428/397 |

FOREIGN PATENT DOCUMENTS

| | | |
|---|---|---|
| EP | 0328320 | 2/1989 |
| GB | 2306438 | 1/1906 |

OTHER PUBLICATIONS

English translation of Abstract of EP0546485; published Jun. 16, 1993.
English translation of Abstract of EP0919650; published Jun. 2, 1999.
English translation of Abstract of EP0427933; published May 22, 1991.
Claims translated from French to English of Swiss Patent No. 333891.

* cited by examiner

*Primary Examiner*—Arti R. Singh
(74) *Attorney, Agent, or Firm*—Hovey Williams LLP

(57) ABSTRACT

According to the invention the labels (22) are produced in a broad woven fabric (21) comprising ground warp yarn (4) and ground weft yarn (5) for a ground woven fabric (11), embroidery weft yarn (12) which forms a figure and code weft yarn (10) which forms a barcode, said yarn being distinguishable from the ground warp yarn only in a light outside the visible spectrum. In the broad woven fabric (21) several labels (22) are produced whose longitudinal sides (1) adjoin each other in the weft direction and remain unfolded and whose lateral sides (2) are adjacent to each other in the warp direction and can be folded. The embroidery weft yarn (12) and the code weft yarn (10) extend parallel to each other and at a distance from the longitudinal sides (1) so that the backs of the labels (22) are evenly covered and thus uniformly transparent. The broad woven fabric (21) is cut along the lateral sides (2) into strips (25) each consisting of transverse labels (22) which are situated one behind the other in the warp direction. The labels (22) are then separated into individual labels by cuts along their longitudinal sides (1), which produces soft cutting edges (16) in the ground woven fabric (11) which do not irritate the skin.

7 Claims, 3 Drawing Sheets

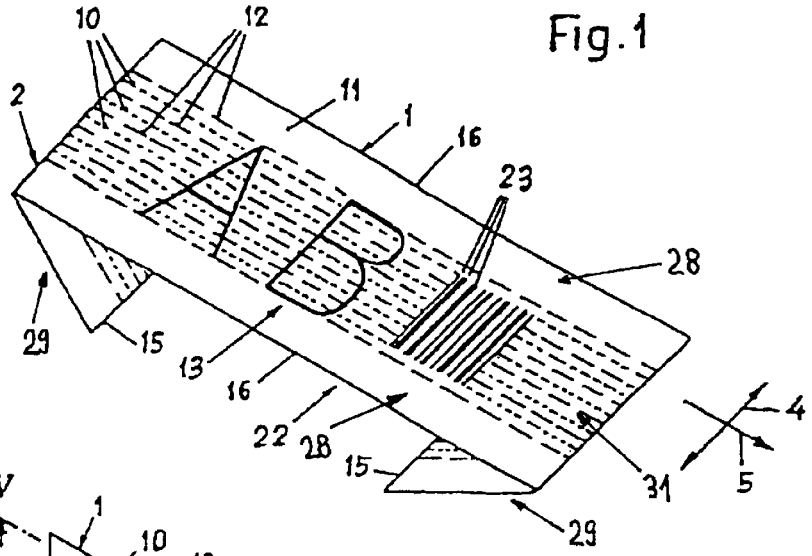
Fig.1
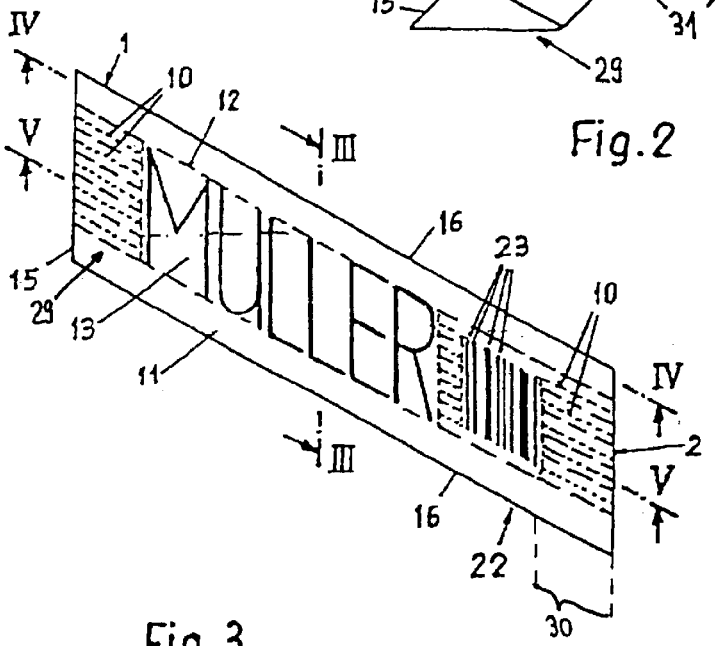
Fig.2
Fig.3
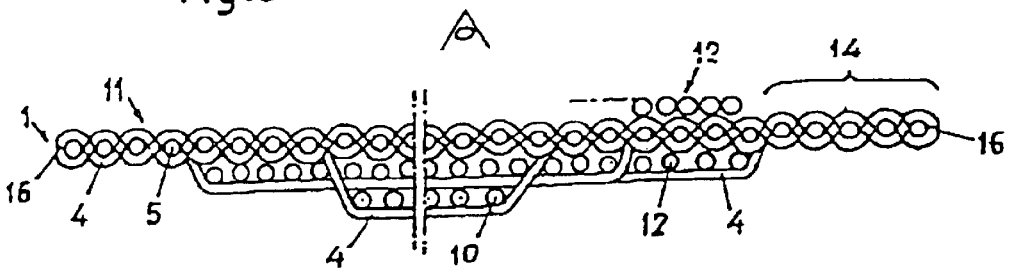

Fig. 4
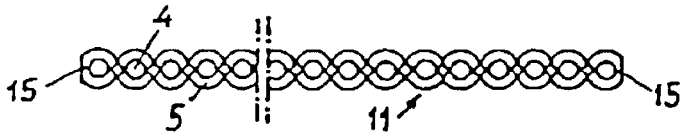
Fig. 5
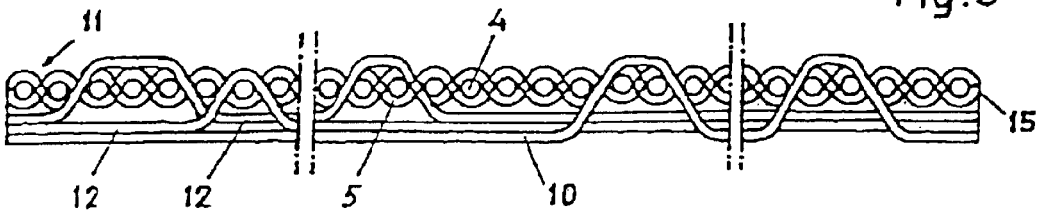
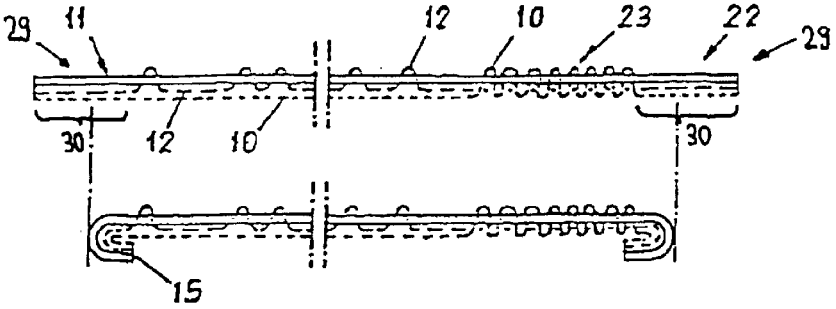
Fig. 6
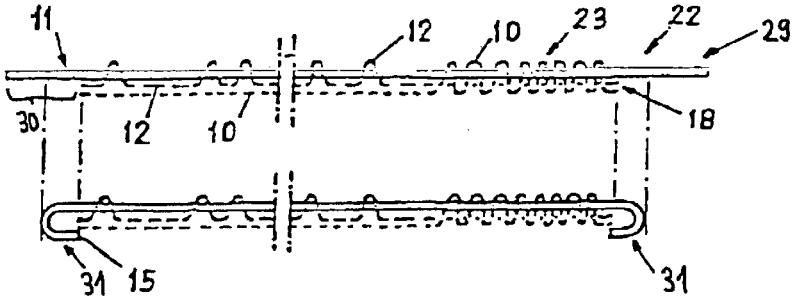
Fig. 7

WOVEN LABELS WITH AN INVISIBLE BAR CODE

This is a national stage application under 35 U.S.C. 371 of International Application PCT/CH00/00234 filed Apr. 27, 2000, and claiming priority under 35 USC Sections 119(a) and 365(b) to Swiss Application No. 1011/99 filed May 29, 1999.

BACKGROUND OF THE INVENTION

1. Field of the Invention

The invention relates to a label made from fusable thread material with a ground fabric formed from ground warp threads. More particularly, it concerns such a label having nonfolded longitudinal sides and foldable narrow sides and with code weft threads which make an invisible bar code and, when observed in visible light, are essentially visually identical to the ground weft thread and can be distinguished therefrom when exposed to light outside the visible spectrum and which are tied to the ground fabric.

2. Description of the Prior Art

A method for the production of said label is known from EP-A-0 919 650, interconnected labels succeeding one another in the warp direction, each with a figure made by embroidery web threads and with a bar code made by code web threads, being produced in a band with a ground fabric consisting of ground warp threads and ground weft threads. The labels each have a rectangular shape with two longitudinal sides and two narrow sides, the warp threads lying parallel to and the weft threads transversely to the longitudinal sides of the label, and the bar codes being formed by code strips in each case running in the weft direction and consisting of one or more parallel code weft threads. One disadvantage is that the cut longitudinal sides have rough edges which are detrimental to wearing comfort and may cause injuries to persons and damage to the wearing support.

EP-A-0 328 320 discloses a label in which the code strips are formed from one or more parallel threads in a similar way to EP-A-0 919 650. No further particulars on the make-up of the fabric and of the code strips can be gathered from EP-A-0 328 320.

The production of labels having usable cut longitudinal sides is a problem which has existed for a long time.

In the first place, in principle, the labels are produced in such a way that the longitudinal edges are oriented parallel to the warp threads, so that the embroidery weft threads are relatively short and a stable formation of the label is obtained. If the label were oriented transversely to the warp threads, the embroidery weft threads would run over a greater length of the label, which would lead to a more unstable formation of the label, particularly in cases where the embroidery weft threads are led in a floating manner. A person skilled in the art therefore selects the arrangement of the labels from fundamental considerations in such a way that their longitudinal side runs in the warp direction and refrains from arranging the labels with their longitudinal sides transverse to the warp direction. If end folds are additionally provided on the narrow sides, each label consists of four plies in this region; this is unacceptable to the user and the wearer.

The person skilled in the art has made great endeavors, in many different directions, to make the longitudinal edges of the labels usable:

In WO 93 02246, an attempt is made to achieve this aim by shaping the undesirable fusion edges on the longitudinal sides of the labels in a noncutting manner by means of a pressing and/or vibrating tool.

In EP-A 0 389 793, it is expressly pointed out in column 1, lines 42 to 54, that experimentation at the fusion edges is useless. Instead, a complicated two-stage method for producing the labels is defined. In a first method stage, a semifinished product with cut longitudinal sides and a greater breadth is produced.

In a second method stage, the semifinished product is folded along the margin to the final breadth and the folded margins are adhesively bonded on the rear side, in order to obtain a soft label. This is therefore an extremely complicated and costly method.

In EP-A-0 427 933 and, in a similar way, in DE-A 41 15 800, webs, produced on a broad weaving machine and lying next to one another, of labels lying one behind the other in their longitudinal direction are produced. In order to avoid rough fusion brows, in a first method step the embroidery weft threads floating between adjacent webs are removed mechanically or thermally and the ground fabric is severed only in a second method step. This is still not considered sufficient, however, since, according to EP-A-0 546 485, in a third method step the warp threads are also removed from the region of the ground fabric, so that fringed edges are obtained on the longitudinal sides. This is likewise a complicated and costly method for the production of labels with soft edges on the longitudinal sides.

SUMMARY OF THE INVENTION

The object of the invention is improvement of labels with an invisible bar code, so that such labels have soft longitudinal sides.

The advantages capable of being achieved by means of the label according to the invention are to be seen essentially in that the longitudinal sides, remaining nonfolded, of the labels are produced with soft and skin-friendly cutting edges and, consequently, wearing comfort is appreciably improved, because the cut edges made by the ground wefts have virtually no brows.

Moreover, such labels can be woven with a different length and breadth on the same type of weaving machine. The cut edges, occurring during the separation of the broad fabric, of the strips can be covered by the foldable narrow sides of the labels, with the result that the labels are further improved. The code weft threads can be inserted with a weft density selectable within wide limits and can be tied into the ground fabric in order to produce the invisible bar codes, while the code strips running in each case in the warp direction and succeeding one another in the weft direction are formed in each case, according to the desired code pattern, by one or more of the warp threads being tied off. Since the weft threads run parallel to the longitudinal sides of the labels, a uniform appearance is achieved over the entire length of each label, because the ground weft threads and also the embroidery weft threads and code weft threads cover the rear side uniformly.

Embodiments of the invention are specified in the dependent claims.

Labels with a weaving repeat can be woven in the broad fabric up to a weaving breadth of approximately 115 cm, so that only a small amount of waste occurs. The weft density in the ground fabric may be selected so that labels with simulated weaves, such as taffeta, half satin and satin, are produced on the same weaving machine. The embroidery weft threads and the cold weft threads can be removed in the marginal region of the strips, so that the end folds become advantageously thin.

BRIEF DESCRIPTION OF THE DRAWINGS

Exemplary embodiments of the invention are explained below by means of drawings in which:

FIG. 1 shows a three-dimensional illustration of a label;

FIG. 2 shows a three-dimensional illustration of a modified version of the label according to the invention shown in FIG. 1;

FIG. 3 shows a section along the line III—III in FIG. 2 on a larger scale;

FIG. 4 shows a section along the line IV—IV in FIG. 2;

FIG. 5 shows a section along the line V–IV in FIG. 2;

FIG. 6 shows side view of the label according to FIG. 2 with a) nonfolded and b) folded transverse sides;

FIG. 7 shows a side view of a modified version of the label according to FIG. 2, with a) nonfolded and b) folded transverse sides;

DESCRIPTION OF THE PREFERRED EMBODIMENTS

Figure 8:
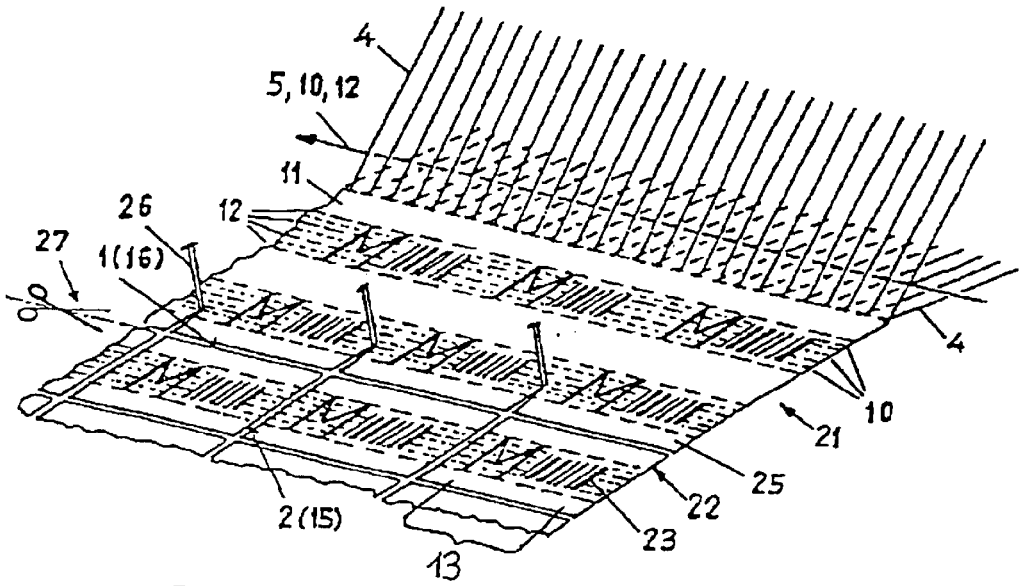
FIG. 8 shows a diagrammatic illustration of a method for the production of the labels according to the invention.

FIG. 1 shows a label 22 according to the invention, from the illustration of which the difference from the known labels in respect of warp direction and weft direction can be seen clearly and which is explained by the following description with reference to FIGS. 2 to 5.

The label 22 has, as is customary, a quadrangular shape with two nonfolded longitudinal sides 1 and two foldable transverse sides 2 which, according to the illustration, are designed as narrow sides. The label 22 consists of a ground fabric 11 made from ground warp threads 4 and ground weft threads 5 and a plurality of embroidery weft threads 12, which make a figure in a region 13 of the label, and a plurality of code weft threads 10, which in the region 13 made a code pattern in the form of a bar code with is "invisible" when observed in visible light and which is formed in each case by code strips 23 running in the warp direction and succeeding one another in the weft direction.

The label 22 is woven in such a way that the ground warp threads 4 run transversely and the ground weft threads 5 parallel to the longitudinal sides of the label 22, a margin 14 of ground fabric 11 being present 22 can be folded on the transverse sides 2 in order to cover the fusion edge 15. The longitudinal sides 1 of the label 22 which are cut by a cutting device run through the ground fabric 11 and each have a cut edge 16 which, as already mentioned, is advantageously soft and skin-friendly.

Reference is made to FIGS. 6 and 7. As FIG. 6*a* shows, the label 22 consists of a ground fabric 11 and of a plurality of embroidery weft threads 12 and code weft threads 10 which make a figure or a bar code in the region 13 of the label 22 and which are tied off in a floating manner on the rear side of the label. According to FIG. 6*b,* the label 22 is folded on the transverse sides 2. FIG. 7*a* shows a corresponding label, in which, in the region of the transverse sides 2, the floating embroidery weft threads 12 and code weft threads 10 are removed on the rear side, so that in each case a portion 18 of the ground fabric 11 is exposed. These portions 18 are folded according to FIG. 7*b,* so that a very thin label is achieved.

The cutting of the longitudinal sides (1) provides stable and skin-friendly edges, which do not have to be folded. They are therefore referred to as non-folded longitudinal sides (28). The narrow sides (2) however, have rough or fringed edges. Folding of the narrow sides (2) is suggested to provide these sides with soft and stable edges as well. Hence, the narrow sides (2) are referred to as foldable narrow sides (29). In order to produce labels of a certain length with foldable narrow sides, the labels need to be woven of greater length. The excess length on each side, which needs to be folded, is referred to herein as a margin region of the narrow side of the label (30). The margin, once folded, is referred to as a margin region folded on the narrow side (31).

The method for the production of labels is described below. As shown in FIG. 8, to produce the labels, in a first step a broad fabric 21 consisting of fusible thread material is made, which has a number of labels 22 lying next to one another and which is woven continuously according to a repeat extending over the weaving breadth. It goes without saying that, as seen over the repeat breadth, each label can be designed differently. The broad fabric 21 is woven (FIG. 5) by the woven fabric technique with around warp threads 4 and ground weft threads 5 for a ground fabric 11 and also with a plurality of embroidery weft threads 12 for the figure and a plurality of code weft threads 10 for a bar code, the embroidery wefts and the code wefts being woven in in a region 13 of each label. In a second step, the broad fabric 21 is separated into a set of strips 25 which contain labels 22 succeeding one another in the longitudinal direction of the strips and lying transversely. For separation, a thermal cutting device 26 is provided, which either is arranged on the weaving machine or is a separate device. If the broad fabric 21 is divided into strips 25, the strips 25 are wound up for further processing. If the broad fabric 21 is not divided into strips, the broad fabric 21 is wound onto a cloth beam (not illustrated). The strips 25 are, in terms of the labels, a semifinished product.

In a third step, the strips 25 may be folded in a folding device along their lateral margins formed by the fusion edges 15, the lengths of the labels 22 being determined and the transverse sides 2 of the labels being formed. At the same time as the folding, the folded portion is fixed, known methods being used. The folded strips 25 are separated by means of mechanical, thermal or ultrasonic devices 27, in such a way that the labels 22 are singled out, at the same time the breadth of the respective label 22 being determined and the cut edges 16 running through the ground fabric 11.

Figure 9:
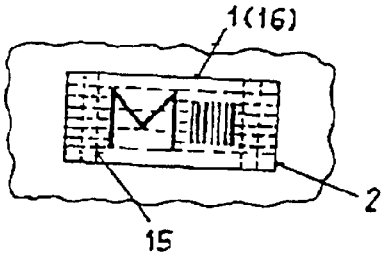
FIG. 9 shows one application of the label according to the invention.

FIG. 9 shows the use of a label 22. The label 22 is stitched with the folded transverse sides 2 onto an article of clothing, so that the fusion edges 15 lie underneath the label 22 and the longitudinal sides 1 with the soft edges are exposed.

What is claimed is:

1. A woven label made from fusible thread material, comprising:

a ground fabric formed from ground warp threads and ground weft threads, said ground fabric having non-folded longitudinal sides and foldable narrow sides; and code weft threads which make an invisible bar code and, when observed in visible light, are essentially visually identical to the ground weft threads and can be distinguished from the ground weft threads when exposed to radiation taking effect outside the visible range and which are tied in the ground fabric, wherein the longitudinal sides are oriented transversely to the ground warp threads and the code weft threads run parallel to and at a distance from the longitudinal sides, said code weft threads floating below the ground fabric and being led onto the top side of the ground fabric in order to form a bar code.

2. The label as claimed in claim 1, wherein the label has embroidery weft thread which form a figure and run parallel to and at a distance from the longitudinal sides, said embroidery weft threads floating below the ground fabric and being led upward to form the figure.

3. The label as claimed in claim 2, wherein the ground fabric has margin regions and the floating embroidery weft threads are removed in the margin regions of the narrow sides of the label.

4. The label as claimed in claim 2, wherein the label has marginal regions folded on the narrow sides.

5. The label as claimed in claim 1, wherein the ground fabric has margin regions and the floating code weft threads are removed in the margin regions of the narrow sides of the label.

6. The label as claimed in claim 5, wherein the label has marginal regions folded on the narrow sides.

7. The label as claimed in claim 1, wherein the label has marginal regions folded on the narrow sides.

* * * * *

UNITED STATES PATENT AND TRADEMARK OFFICE

CERTIFICATE OF CORRECTION

PATENT NO. : 6,764,970 B1
DATED : July 20, 2004
INVENTOR(S) : Kuoni, Christian

It is certified that error appears in the above-identified patent and that said Letters Patent is hereby corrected as shown below:

Column 5,
Line 5, change “thread” to -- threads --.

Signed and Sealed this

Twenty-second Day of February, 2005

JON W. DUDAS
*Director of the United States Patent and Trademark Office*